United States Patent [19]

Carlsson

[11] Patent Number: 4,544,105

[45] Date of Patent: Oct. 1, 1985

[54] SEPARATING DEVICE FOR A WOOD CHIPPER

[75] Inventor: Jan E. K. Carlsson, Vittaryd, Sweden

[73] Assignee: KMW ERJO AB, Lagan, Sweden

[21] Appl. No.: 562,454

[22] Filed: Dec. 16, 1983

[51] Int. Cl.[4] ..... B02C 23/00

[52] U.S. Cl. ..... 241/73; 241/101.7; 241/285 A

[58] Field of Search ..... 241/79, 73, 285 A, 101.7, 241/285 R, 222, 285 B

[56] References Cited

U.S. PATENT DOCUMENTS

| | | | |
|---|---|---|---|
| 1,928,887 | 10/1933 | Gredell | 241/73 |
| 3,813,045 | 5/1974 | Greiffenstern | 241/285 A X |
| 4,146,184 | 3/1979 | Whitney | 241/285 A X |
| 4,449,673 | 5/1984 | Cameron | 241/285 A X |

FOREIGN PATENT DOCUMENTS

| | | |
|---|---|---|
| 75063768 | 6/1975 | Sweden . |
| 66086042 | 3/1977 | Sweden . |
| 80031859 | 4/1980 | Sweden . |

*Primary Examiner*—Mark Rosenbaum

*Attorney, Agent, or Firm*—Bell, Seltzer, Park & Gibson

[57] ABSTRACT

In a separating device for a wood chipper comprising a chipper rotor housing and a chipper rotor rotatably journalled therein it is proposed in accordance with the invention to provide the separating device with a plurality of ribs defining between themselves spaces through which wood chips of a predetermined maximum size and less are passing to an outlet of the chipper rotor housing. Each rib has an arc-shaped edge facing the chipper rotor with a radius which has its center coincident with the axis of rotation of the chipper rotor, said edge being arranged at a predetermined distance from the cylindrical surface of the chipper rotor in order to form a free passage for pieces of material which are larger than the desired maximum size of discharged chips.

4 Claims, 7 Drawing Figures

SEPARATING DEVICE FOR A WOOD CHIPPER

FIELD OF THE INVENTION

The present invention relates to a separating device for a wood chipper comprising a chipper rotor housing and a chipper rotor rotatably journalled therein, said chipper rotating housing having inlet means for feeding material intended for chipping to the chipper rotor and outlet means for discharging wood chips produced by the chipper rotor. More particularly, the separating device is arranged before said outlet means for removing from a flow of chips pieces of material which are larger than a predetermined maximum size of the discharged chips.

BACKGROUND OF THE INVENTION AND PRIOR ART

Swedish patent application No. 8003185-9 describes a mobile chipper which is equipped with a special device comprising a cutter drum having cam-like cut strips which cooperate with a complementary counter member in order to disintergrate branches and other parts of trees that turn across the feed direction after the actual chipping has been carried out in a chipper rotor. However, such a device requires more space for the chipper, and extra bearings and drive mechanisms for the special device.

Swedish patent application No. 7506376-8 discloses a wood chipper which is provided with a permanent lattice plate, whereby such material which cannot pass through the lattice plate is returned by the chipper drum to the chipping site while the material passing through the lattice plate is caught on a screen plate for screening. The employment of a permanent lattice is also described in Swedish patent specification No. 6608604-2.

SUMMARY OF THE INVENTION

An object of the present invention is to obtain a simple replaceable separating device for a wood chipper which separating device makes it possible to remove too large pieces of material, such as branches and twigs, from the discharged flow of chips, said pieces of material passing the chipping site without being disintergrated at all or insufficiently due to the fact that the pieces of material are located substantially transversely to the feeding direction whereas chips of the desired maximum size and less are allowed to pass through the separating device.

Another object of the invention is to obtain a set or system of such easily replaceable separating devices which makes it possible for one and the same wood chipper to be adapted easily to different types of raw materials so that optimal operating conditions can be rapidly set in each individual case with respect to said type of raw material.

These objects are achieved according to the invention in that said separating device comprises a supporting means and a plurality of oblong, substantially parallel, uniform ribs attached to said supporting means, said ribs defining between themselves substantially equally large spaces through which chips of said maximum size and less are passing to said outlet means, each of said ribs having a portion with an arc-shaped edge facing said chipper rotor, the radius of said edge having its centre substantially coincident with the axis of rotation of said chipper rotor, said arc-shaped edge being arranged at a predetermined distance from the cylindrical surface of said chipper rotor in order to form a free passage therebetween for said pieces of material which are larger than the desired maximum size of discharged chips.

The invention will be described in more detail in the following with reference to the accompanying drawings.

DESCRIPTION OF THE ILLUSTRATED EMBODIMENTS

Figure 1:
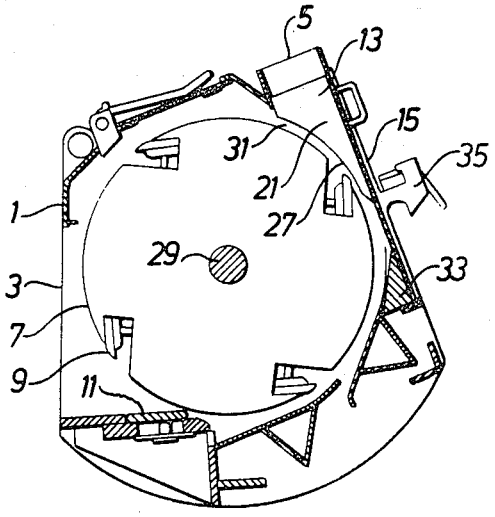
FIG. 1 is a cross section of a chipper rotor housing of a wood chipper which is provided with a separating device in accordance with a preferred embodiment of the invention.

With reference to FIG. 1 there is shown a chipper rotor housing 1 for a wood chipper which has inlet and outlet means. The chipper rotor housing can be arranged for rotation or pivotal movement on a stand, and a fan (not shown) connected to the outlet means can be arranged stationarily in relation to the chipper rotor housing 1 in order to maintain the setting of the fan outlet unchanged during the turning of the chipper rotor housing 1 as is described in our copending application Ser. No. 562,455. The material to be chipped is fed in through an inlet opening 3 and the chips having the desired maximum size and less are removed through an outlet opening 5. A chipper rotor 7 is rotatably journalled in the chipper rotor housing 1 and is provided with a plurality of chipper knives 9 (omitted in FIG. 2) which cooperate with a fixed counter member 11.

In front of, i.e. before, the outlet opening 5 there is a separating device 13 according to one embodiment of the present invention. The chipper rotor housing 1 is provided with an opening 15 arranged on the side facing away from the inlet opening 3 for insertion of the separating device. The separating device is formed as a cassette or unit comprising a supporting means in the form of a supporting plate 17 with two handles 19 arranged on the outer surface thereof. The supporting plate 17 which may be flat as is shown or curved supports on its inner surface a plurality of oblong, parallel, uniform ribs 21 which have opposite, parallel surfaces being perpendicular to the supporting plate 17. Said ribs 21 are linear and arranged at predetermined, equal or substantially equal distances from each other to form spaces 23 therebetween such that chips of the desired maximum size and less are allowed to pass through the spaces 23 in the longitudinal direction of the ribs 21. The spaces 23 are open in the longitudinal direction of the cassette, i.e. at both the upstream end and the downstream end, seen in the direction of the flow of chips. The spaces are also open at the inside of the cassette facing the chipper rotor 7 whereby said downstream end connects to the outlet opening 5 of the chipper rotor housing 1. Each rib 21 comprises an upstream located portion 25 which has an arc-shaped edge 27 of predetermined length facing the chipper rotor 7 and with a somewhat larger radius than the chipper rotor 7, said larger radius having its centre in or substantially in the axis 29 of rotation of the chipper rotor 7. Thus, the arc-shaped edges 27 of the ribs will be arranged at a predetermined distance from the cylindrical surface of chipper rotor 7 so that too large, i.e. usually too long, pieces of material are allowed to by-pass the cassette in the free passage 31 thus formed in order to be returned to the chipping site at the counter member 11, whereas chipped pieces of the desired maximum size and less are allowed to pass between the ribs 21 and further out through the outlet opening 5.

Figure 2:
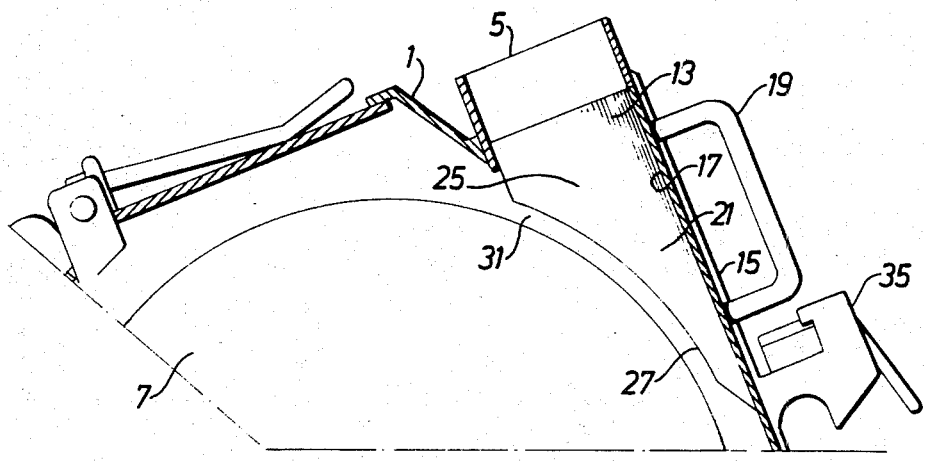
FIG. 2 is an enlarged view of the upper section of the chipper rotor housing shown in FIG. 1.
Figure 3:
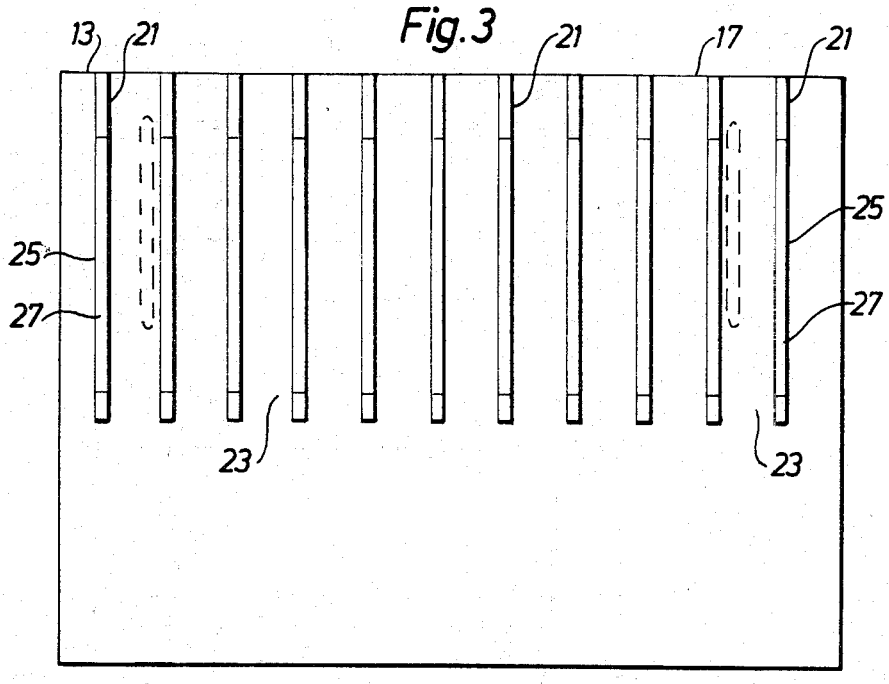
FIGS. 3 and 4 show the separating device according to FIGS. 1 and 2 in a top view and an end view, respectively.
Figure 4:
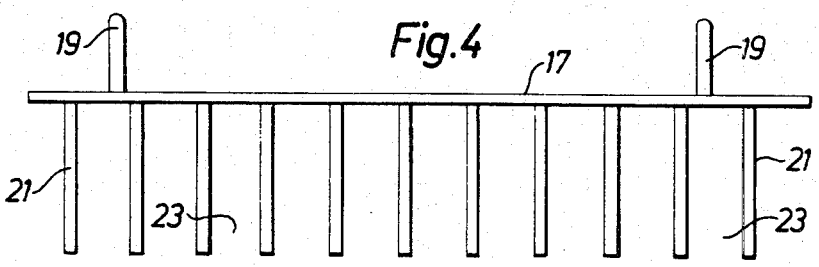

The cassette opening 15 is adapted to receive the cassette and is closed by the supporting plate 17 thereof as is shown in FIGS. 1 and 2. Suitable upper (not shown) and lower supporting devices 33 are arranged in the chipper rotor housing 1 in order to hold the cassette in its correct position. The cassette is locked in said position by means of suitable locking means 35.

The cassette described above is easy to insert into and remove from the chipper rotor housing 1 and can thereby be easily replaced by another cassette which has the same external appearance but has a different distance between the ribs in order to produce a chips product having another desired maximum size of the chipped pieces.

If desired, the arc-shaped edges may be formed with different radii for different cassettes in order to vary the distance to the cylindrical surface of the chipper rotor so that the by-passing of the cassette by oversized pieces of material is facilitated when the chipper knives entrain oversized pieces of material. A plurality, i.e. a set or system of such replaceable cassettes, make it possible to rapidly attain optimum operating conditions by making simple tests with different cassettes to determine the correct cassette for a specific material which is to be chipped. One and the same wood chipper can thereby be employed for a number of different raw materials including such in which the parts of the material are in a disordered form, e.g. joinery waste. The cassettes included in the system have thus mutually different distances between the ribs 21 and optionally also different radii of the arc-shaped edge 27 in order to vary the distance between the cassette and the chipper drum, i.e. the size of the passage 31.

Figure 5:
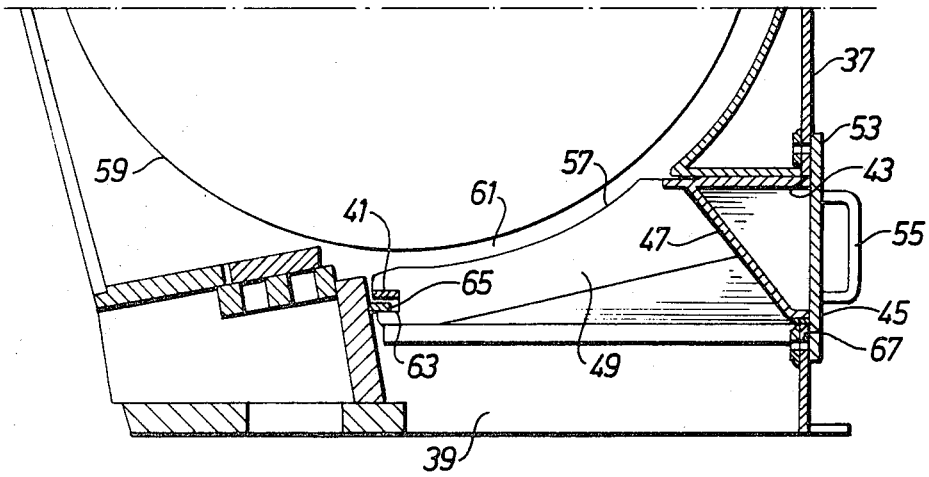
FIG. 5 is a cross section of the lower section of a stationary rotor housing with a separating device according to another embodiment of the invention.
Figure 6:
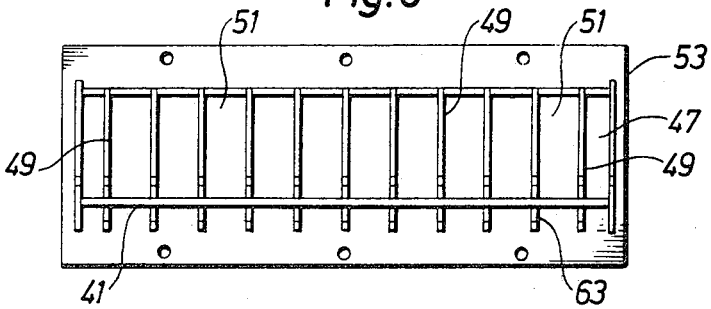
FIGS. 6 and 7 show the separating device according to FIG. 5 in an end view and a top view, respectively.
Figure 7:
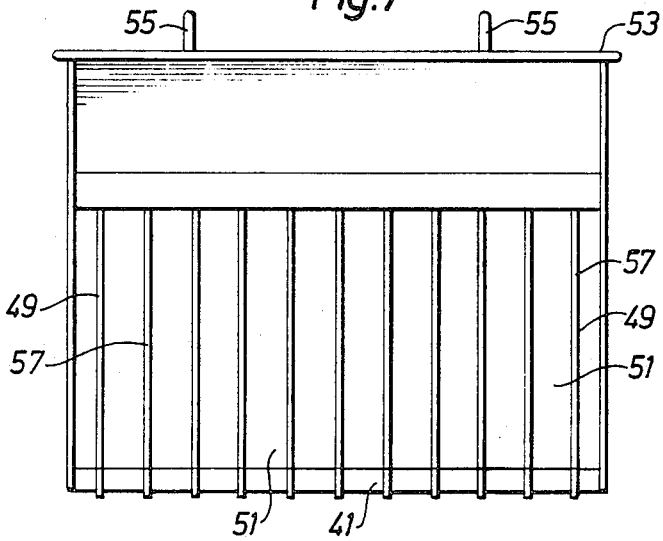

With reference to FIG. 5 there is shown the lower section of a wood chipper according to another embodiment wherein the chipper rotor housing 37 has its outlet opening 39 in its lower section for discharging the chips at the bottom. The chipper rotor housing 37 is rigidly mounted on a base (not shown) and has a lateral opening 43 for the insertion of a separating device 45 in the form of a cassette in accordance with another embodiment of the invention. In conformity with the first described cassette the one shown in greater detail in FIGS. 6 and 7 comprises a supporting means in the form of a supporting plate 47 and a plurality of parallel, uniform, oblong ribs 49 which are arranged at predetermined, equal or substantially equal distances from each other to form spaces 51 therebetween such that chips of the desired maximum size and less are allowed to pass through the spaces 51 in the longitudinal direction of the ribs 51. While the first described cassette has each rib 21 attached to the supporting plate 17 at the one longitudinal side of the rib, each rib 49 is in accordance with this second embodiment attached to the supporting plate 47 at the one end side of the rib. The supporting plate 47 is oblique and is connected to an outer wall 53 which has two handles 55. The spaces 51 are open across the longitudinal direction of the cassette, i.e. at opposite longitudinal sides of the ribs 49. Each rib 49 has its longitudinal side facing the chipper rotor 59 formed as an arc-shaped edge 57 of predetermined length and with somewhat larger radius than the chipper rotor 59, said larger radius having its centre in or substantially in the axis of rotation of the chipper rotor 59. Thus, the arc-shaped edges 57 of the ribs will be arranged at a predetermined distance from the cylindrical surface of the chipper rotor 59 so that too large, i.e. usually too long, pieces of material are allowed to by-pass the cassette in the free passage 61 thus formed in order to be returned to the chipping site at the counter member whereas chipped pieces of the desired maximum size and less are allowed to pass between the ribs 49 and further out through the outlet opening 39.

The end of the cassette facing away from the supporting plate 47 has a plate bar 41 connecting the ribs. Each rib 49 is provided with a recess 63 for cooperating with an inner supporting means 65 in the chipper rotor housing 37 so that the inserted cassette is held in the correct position (horizontally) while it rests on the lower edge 67 of the cassette opening 43. The cassette is locked in its inserted position by means of suitable locking devices. The cassette is easily replaceable and advantageously forms part of a set or system of such cassettes identical in their external appearance but with mutually different rib spaces and optionally different radii of the arc-shaped edge 57 as previously described.

What I claim is:

1. A wood chipper comprising a chipper rotor housing, a chipper rotor rotatably journaled in said rotor housing, said chipper rotor housing having inlet means for feeding material intended for chipping to the chipper rotor and outlet means for discharging wood chips produced by the chipper rotor, and having an opening located before said outlet means and being adapted for receiving a separating device for separating from a flow of wood chips, pieces of material which are larger than a predetermined maximum size for discharged chips, and said wood chipper including a set of externally identical separating devices, a selected one of the separating devices of said set being positioned in and closing said opening in the rotor housing, and wherein each of the separating devices of said set comprise a supporting means and a plurality of oblong, substantially parallel, uniform ribs attached to said supporting means, said ribs defining between themselves spaces through which chips of said maximum size and less may pass to said outlet means, each of said ribs having a portion with an arc-shaped edge facing said chipper rotor, the radius of said edge having its center substantially coincident with the axis of rotation of said chipper rotor, said arc-shaped edge being arranged at a predetermined distance from the cylindrical surface of said chipper rotor in order to form a free passage therebetween for pieces of material which are larger than the desired maximum size of discharged chips, and wherein the respective separating devices of said set have different numbers of ribs and thereby different spacing between the ribs so that by inserting a selected one of the separating devices of the set into said opening in the chipper rotor housing, the size of the wood chips discharged from the wood chipper may be controlled.

2. A wood chipper according to claim 1 wherein said ribs are attached to said supporting means along the one longitudinal side of the rib.

3. A wood chipper according to claim 1 wherein said ribs are attached to said supporting means at the one end side of the rib.

4. A wood chipper according to claim 1 wherein said arc-shaped edges of the ribs of the separator devices are formed with different radii for different separator devices of the set in order to vary the distance from the cylindrical surface of said chipper rotor.

* * * * *